US007735965B2

(12) United States Patent
Goin et al.

(10) Patent No.: US 7,735,965 B2
(45) Date of Patent: Jun. 15, 2010

(54) OVERHANGING NOZZLES

(75) Inventors: Richard L. Goin, Lexington, KY (US); Colin G. Maher, Georgetown, KY (US); Shirish P. Mulay, Lexington, KY (US); Girish S. Patil, Lexington, KY (US); James H. Powers, Lexington, KY (US)

(73) Assignee: Lexmark International Inc., Lexington, KY (US)

( * ) Notice: Subject to any disclaimer, the term of this patent is extended or adjusted under 35 U.S.C. 154(b) by 1181 days.

(21) Appl. No.: 11/095,956

(22) Filed: Mar. 31, 2005

(65) Prior Publication Data

US 2006/0218789 A1 Oct. 5, 2006

(51) Int. Cl.
*B41J 3/04* (2006.01)

(52) U.S. Cl. ..... 347/47; 29/890.1

(58) Field of Classification Search ..... None
See application file for complete search history.

(56) References Cited

U.S. PATENT DOCUMENTS 5,331,344 A 7/1994 Miyagawa et al.
5,478,606 A 12/1995 Ohkuma et al.
6,045,214 A * 4/2000 Murthy et al. ..... 347/47
6,310,639 B1 10/2001 Kawamura et al.
6,310,641 B1 10/2001 Mrvos et al.
6,328,428 B1 12/2001 Keefe et al.
6,409,312 B1 6/2002 Mrvos et al.
6,520,626 B1 * 2/2003 Murakami ..... 347/56
6,619,779 B2 9/2003 Jeon et al.
6,644,789 B1 11/2003 Toews, III
6,676,244 B2 1/2004 Kwon et al.
6,702,429 B2 * 3/2004 Lin ..... 347/65
6,709,805 B1 3/2004 Patil
6,719,405 B1 * 4/2004 Powers ..... 347/62
6,848,772 B2 * 2/2005 Kim ..... 347/63
6,868,605 B2 * 3/2005 Maeng et al. ..... 29/890.1
6,922,892 B2 * 8/2005 Kim et al. ..... 29/890.1
6,942,318 B2 * 9/2005 Fartash ..... 347/44
2002/0039123 A1 4/2002 Lee et al.
2002/0041301 A1 4/2002 Jeon et al.
2003/0030697 A1 2/2003 Kwon et al.
2003/0081075 A1 5/2003 Kim et al.
2003/0081076 A1 5/2003 Park et al.
2003/0081078 A1 5/2003 Maeng et al.
2003/0085960 A1 5/2003 Kim et al.
2003/0112300 A1 * 6/2003 Chung et al. ..... 347/71
2003/0197762 A1 10/2003 Park et al.
2004/0040929 A1 * 3/2004 Kim ..... 216/27
2004/0052689 A1 * 3/2004 Yao ..... 422/100
2004/0075716 A1 4/2004 Shin et al.
2004/0100535 A1 5/2004 Song et al.
2004/0169700 A1 9/2004 Lee et al.

* cited by examiner

*Primary Examiner*—Stephen D Meier
*Assistant Examiner*—Alexander C Witkowski

(57) ABSTRACT

A fluid ejector, such as a printhead for an inkjet printer, comprising a substrate that includes a primary via formed therein, and a nozzle member overlying the substrate and including vertical nozzle chambers at least partially overlying the primary via and a corresponding fluid actuator (e.g., a heater) associated with the substrate.

23 Claims, 7 Drawing Sheets

OVERHANGING NOZZLES

FIELD OF THE INVENTION

The present invention is directed to fluid ejection and, more specifically, to fluid ejectors having nozzles and/or nozzle chambers that vertically overlie a primary via within a substrate.

RELATED ART

Inkjet printing apparatus, such as printers and multi-function devices, rely on the transfer of ink from a source to a nozzle chamber where the ink is ejected through an orifice of the nozzle chamber and onto a print medium. Common conduit systems for delivering ink to nozzles of an inkjet printer include a primary via formed within a silicon substrate that provides the sole on-chip source of ink. A series of horizontal channels are fabricated during the printhead fabrication sequence to provide fluid communication between the primary via and respective nozzle chambers in order to allow ink from the primary via to refill each nozzle chamber subsequent to the firing of a respective fluid actuator.

Thermal inkjet printers utilize fluid actuators that comprise electrical resistors (referred to hereinafter as "heaters") that are "fired" by passing an electrical current through each heater in order to generate thermal energy. The thermal energy generated upon firing of a heater is relatively local and sufficient to vaporize a small fraction of ink in thermal communication with the heater, preferably to vaporize ink within the nozzle chamber. The pressure differential and expansion of fluid to a gaseous state within the nozzle chamber forces the remaining liquid ink within the chamber through the nozzle orifice and onto the print medium.

Referencing U.S. Pat. No. 6,409,312, fabrication of these exemplary inkjet printheads requires forming the primary via within the substrate, as well as forming the heaters to be substantially offset from the primary ink via. Thereafter, a first photo-imageable layer is applied over the substrate to cover the primary ink via and thereafter developed to create horizontal channels connecting the primary via to the eventual nozzle chamber. A second photo-imageable layer is applied over the first photo-imageable material and thereafter developed to create the vertical nozzle chambers. It should be noted, however, that the nozzle chambers do not overly the primary ink via and therefore are dependent upon the horizontal chamber for fluid communication with the primary ink via and its associated fluid dynamics for refill characteristics.

Other exemplary printheads are constructed using heater bridges. For example, U.S. Pat. No. 6,676,244 discloses a heater assembly adapted to generate bubbles of ink vapor in a direction opposite that of the nozzle orifice. These printheads may suffer from insufficient heat capacity surrounding the heater and the associated complexity of fabricating the electrical leads and bridging structure. Those of ordinary skill are familiar with the problems associated with the drawbacks with utilizing a bridge structure such as insufficient heater cooling that may lead to inadvertent ink ejection.

Exemplary embodiments of the present invention obviate the need for horizontal channels to provide fluid communication between a primary via and a nozzle chamber, and simplify the fabrication process (e.g., by eliminating the process step to form the horizontal channel between the nozzle chamber and the primary via). Exemplary embodiments of the present invention also do not rely on a complex bridging structure incorporating the heater, but instead mount the heater to the bulk substrate.

SUMMARY OF THE INVENTION

The present invention is directed to fluid ejection and, more specifically, to fluid ejectors having nozzles and/or nozzle chambers that vertically overly a primary via within a substrate. Exemplary embodiments of the present invention include forming nozzle chambers within a nozzle plate that vertically overly the primary via and/or vertical conduits fed by the primary via, as well as the heaters mounted on or associated with the substrate. The walls of the nozzle chambers may be tapered to increase the cross-sectional area of the chamber as the distance from the nozzle increases. In exemplary form, the nozzle chamber defines a frustoconical region, where a base of the frustoconical region overlies the primary via or a vertical conduit associated with the primary via.

Embodiments of the present invention might also include methods and resulting devices having chamfered edges to meter the fluid (e.g., ink) between the nozzle chamber and the primary via. Those of ordinary skill will readily understand that the chamfered nature of the edges may be manipulated during fabrication to achieve the desired metering.

It is a first aspect of the present invention to provide a fluid ejector comprising: (i) a substrate that includes a primary via formed therein; and (ii) a nozzle member overlying the substrate and including vertical nozzle chambers at least partially overlying the primary via and a corresponding fluid actuator associated with the substrate In a more detailed embodiment of the first aspect, the nozzle member and substrate cooperate to form a constriction that is adapted to meter the flow of fluid between the primary via and at least one vertical nozzle chamber. In yet another more detailed embodiment, at least one of the nozzle member and substrate that cooperate to form the constriction are chamfered. In a further detailed embodiment, at least one of the fluid actuators is recessively mounted to the substrate. In still a further detailed embodiment, fluid from the primary via is adapted to vertically refill each of the vertical nozzle chambers. In a more detailed embodiment, at least one of the vertical nozzle chambers includes a tapered wall. In a more detailed embodiment, the at least one vertical nozzle chamber includes at least two tapered walls, the first tapered wall is angled greater than the second tapered wall, and the first tapered wall at least partially overlies the primary via.

In yet another more detailed embodiment of the first aspect, the tapered wall at least partially defines a frustoconical region. In still another more detailed embodiment, at least one of the vertical nozzle chambers includes a nozzle orifice at least partially overlying the primary via. In a further detailed embodiment, the primary via is horizontally staggered, the fluid actuators are horizontally staggered, and the vertical nozzle chambers are correspondingly horizontally staggered to match the orientation of the fluid actuators and primary via. In still a further detailed embodiment, the nozzle member is photolithographically developed to define the vertical nozzle chambers. In a more detailed embodiment, the nozzle member comprises a metallic material, and the vertical nozzle chambers are formed through the nozzle member utilizing at least one of laser ablation and electroplating. In a more detailed embodiment, the substrate includes a conduit formed between the primary via and at least one of the vertical nozzle chambers to regulate the refill of fluid into the at least one vertical nozzle chamber. In another more detailed embodiment, the substrate includes a plurality of conduits formed between the primary via and at least one of the vertical nozzle chambers to regulate the refill of fluid into the at least one vertical nozzle chamber.

It is a second aspect of the present invention to provide a method of fabricating a printhead for an inkjet printing apparatus comprising: (i) forming an ink via within a substrate; (ii) overlying the substrate with a nozzle plate; and (iii) forming a plurality of orifices through the nozzle plate, where the plurality of orifices are adapted to overly at least a portion of the ink via and a corresponding heater mounted to the substrate to provide a plurality of overhanging nozzles.

In a more detailed embodiment of the second aspect, the nozzle plate comprises a photosensitive material, and the photosensitive material is exposed to light and developed in order to form the plurality of overhanging nozzles. In yet another more detailed embodiment, the act of forming a plurality of orifices through the photosensitive material includes utilizing a photolithographic gray scale mask. In a further detailed embodiment, the act of forming the plurality of orifices through the nozzle plate includes utilization of at least one of laser ablation and electroplating. In still a further detailed embodiment, the act of forming the ink via within the substrate occurs prior to overlying the substrate with the nozzle plate. In a more detailed embodiment, the act of overlying the substrate with the nozzle plate occurs prior to the act of forming the plurality of orifices through the second material.

In yet another more detailed embodiment of the second aspect, the act of forming the ink via within the substrate occurs subsequent to overlying the substrate with the nozzle plate, the act of forming the ink via within the substrate includes utilization of at least one of reactive ion etching and chemical etching, and the nozzle plate is operative as an etch stop. In still another more detailed embodiment, the act of overlying the substrate with the nozzle plate includes at least one of: (i) laminating a nozzle plate film onto the substrate, and (ii) applying a spin-on liquid composition and subsequently developing the spin-on liquid composition to form a nozzle plate film overlying the substrate. In a further detailed embodiment, the act of overlying the substrate with the nozzle plate occurs subsequent to the act of forming the plurality of orifices through the nozzle plate.

DETAILED DESCRIPTION

The exemplary embodiments of the present invention are described and illustrated below to encompass exemplary inkjet printheads. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below include optional steps, methods, features, and apparatuses that one of ordinary skill should recognize as not being a requisite to fall within the scope of the present invention.

Figure 1:
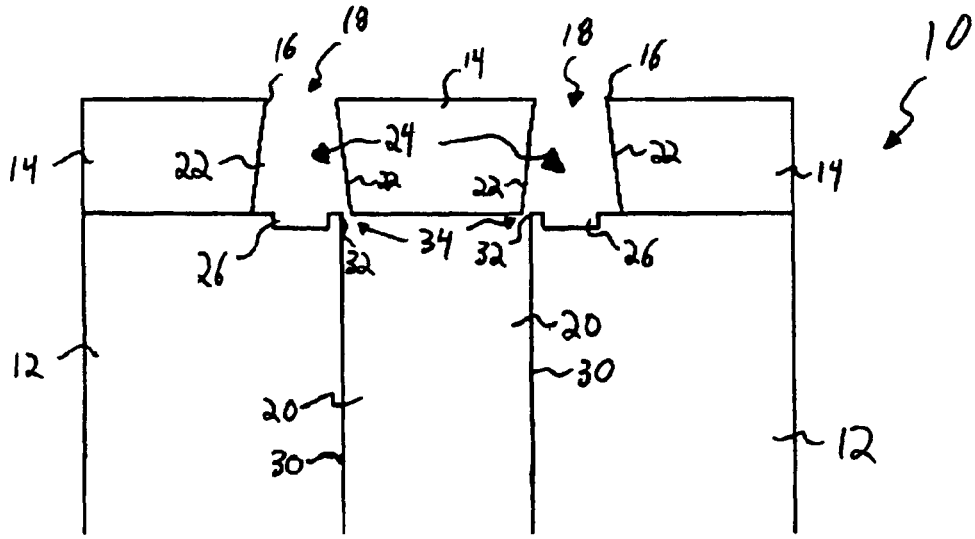
FIG. 1 is a cross-sectional view of a first exemplary printhead in accordance with the present invention.
Figure 2:
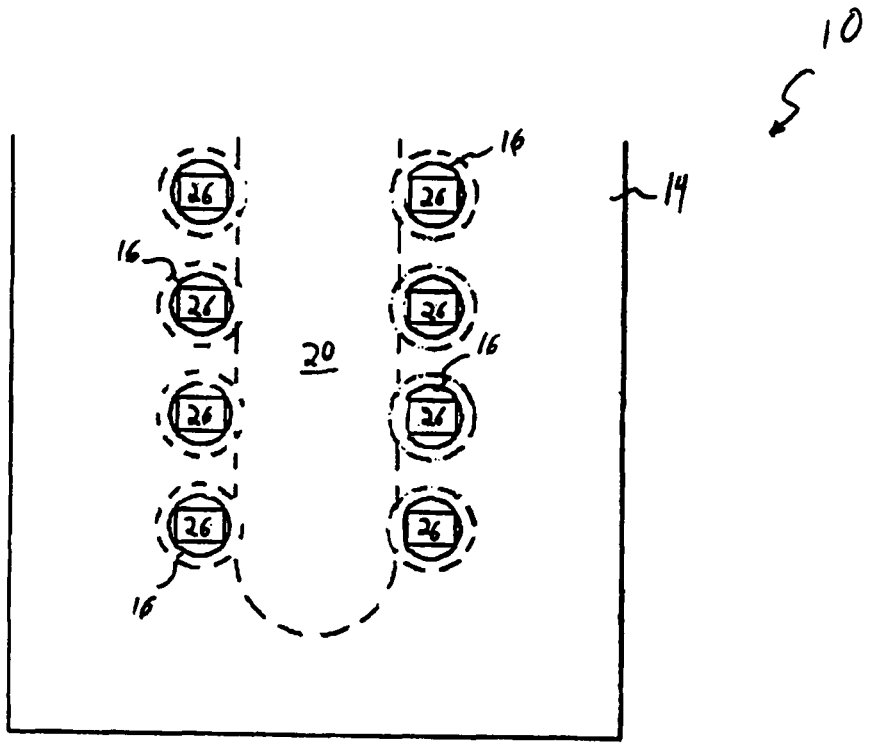
FIG. 2 is an overhead view of the first exemplary printhead of FIG. 1.

Referencing FIGS. 1 and 2, a first exemplary printhead 10 includes a silicon substrate 12 and a nozzle plate 14 having a plurality of horizontally aligned nozzles 16 through which a fluid such as ink is ejected. The nozzle plate 14 includes a series of vertical shafts 18 formed through the nozzle plate 14 that are vertically aligned over at least a portion of a primary ink via 20 formed within the substrate 12. Each shaft 18 includes tapered walls 22 having a circular cross-section that increases in area as the distance from the corresponding nozzle 16 increases to define a frustoconical nozzle chamber 24. At least a portion of the frustoconical nozzle chamber 24 vertically overlies a corresponding heater 26 recessively mounted within the substrate 12.

In this exemplary orientation, the primary via 20 includes vertical walls 30 that are blocked off to provide a normal edge 32. The normal edge 32 of the via 20 and the tapered walls 22 of the frustoconical nozzle chamber 24 define a constriction 34 through which ink must pass from the via 20 prior to entering the frustoconical nozzle chamber 24. As will be described in more detail below, the geometries associated with the walls 30 of the via 20 and the walls 22 of the shafts 18 can be varied to accommodate predetermined rates of refilling.

In an exemplary operational sequence of an exemplary inkjet printer (not shown), a printer controller (not shown) is operative to selectively fire one or more heaters 26 associated with the printhead 10. The firing of a heater 26 generates a local area of higher thermal energy that is transferred to the substrate 12 and the ink directly above the heater. The extent to which this thermal energy is transferred to particular aspects of the printhead 10 is accounted for in this exemplary embodiment by the orientation and location of the heater 26 with respect to the substrate 12, via 20, and nozzle chambers 24.

For example, prior art designs included a horizontal conduit linking the primary ink via with the vertically oriented nozzle chamber, where the heater was spaced a considerable distance from the via. The nozzle chamber of some of these prior art designs included a heater mounted to a thin bridge extending into the nozzle chamber. While some of these prior art designs included heaters facing the nozzle or heaters facing away from the nozzle, a common theme remained that the heater and backside of the bridge were each in contact with ink within the nozzle chamber or the atmosphere, but in any event were not in intimate thermal communication with the silicon substrate. These prior art bridge designs have suffered from an insufficient thermal capacity of the bridge, resulting in overheating of the silicon supporting the heater. Likewise, such bridges having the backside exposed to the atmosphere have also suffered from insufficient heat sink capacity. Without a proper heat sink, unintended bubble formation on the backside of the bridge or on the front side of the heater may result that hinders ink from being properly ejected through the nozzle and degrades the filling characteristics of the nozzle chamber.

Referring again to FIG. 1, the design of the exemplary printhead 10 is mindful of thermal energy transfer considerations, particularly where the primary ink via 20 directly feeds the nozzle chamber 24. When an exemplary heater 26 is fired, thermal energy is transferred to ink directly above the heater and within the nozzle chamber 24 to generate a bubble that forces the remainder of the ink within the chamber 24 through the nozzle. By mounting the heater 26 to the bulk substrate 12, as opposed to prior art bridge designs, each heater may be closer to the primary via 20 without transferring sufficient thermal energy to the ink within the primary via 20 to generate bubbles therein that might become lodged within the constriction 34 or slow the refilling of ink within the nozzle chamber 24.

A first exemplary process for fabricating of the first exemplary printhead 10 includes forming a primary ink via 20 within a silicon substrate 12. Exemplary techniques for forming an ink via 20 within the substrate include, without limitation, deep reactive ion etching (DRIE) and chemical etching. Resistors on the substrate 12 are electrically connected to provide an array of heaters that will generate the thermal energy required for bubble formation. A heater overcoat is applied over the resistors to inhibit intimate fluid communication between the resistors and ink. The heater overcoat can comprise a dielectric layer and a passivation layer. The dielectric layer, which insulates the ink from the current in the heater may comprise silicon oxide, silicon nitride, silicon carbide, diamond like carbon, tantalum oxide or some combination of these, for example. The passivation layer, which protects the heater from the collapse of the vapor bubble-commonly known as cavitation, may comprise, for example, tantalum. These layers are deposited through standard PECVD or sputtering processes, then patterned with standard masked etching techniques. A photolithographic film that will eventually comprise the nozzle plate 14 is layered over the substrate 12, via 20, and heaters 26 on the order of 25 μm and may be applied using spin-on or spray on films such as, without limitation, SU8 available from Microchem Corporation or dry laminate films such as, without limitation, Vacrel or Riston available from Dupont Corporation. The photolithographic film 14 is developed using conventional techniques to create shafts 18 extending completely through the film that define the nozzles 16 and the nozzle chambers 24 that overly at least a portion of the via 20. Those of ordinary skill are familiar with the techniques for developing photolithographic material that include, without limitation, positive photo development and negative photo development, with or without the utilization of a gray scale mask. In this exemplary embodiment, a positive photo development technique is utilized with a gray scale mask to selectively develop the film. A solvent is applied to the surface of the film to dissolve those portions left undeveloped by exposure to light, thereby creating the tapered walls 22 defining the frustoconical area of the nozzle chamber 24.

A second exemplary process for fabricating of the first exemplary printhead 10 includes first etching the recesses in the substrate 12 that are adapted to accommodate the heaters 26 and the associated electrical contacts. The heaters 26 and the associated electrical contacts are thereafter mounted to the substrate 12, followed by a heater overcoat and a photolithographic film being applied over the substrate 12 that covers the heater overcoat, heaters 26, and associated electrical contacts. At this point, the via 20 within the substrate has not been formed, nor have the plurality of shafts 18 through the film been formed that will eventually define the nozzles 16 and nozzle chambers 24. Subsequent to the photolithographic film being applied to the substrate 12, the ink via 20 is formed within the substrate, optionally utilizing the photolithographic film as an etch stop for deep reactive ion etching (DRIE) and/or chemical etching. After the via 20 has been formed, the shafts 18 within the photolithographic film are created as discussed above and known to those of ordinary skill.

It is also within the scope of the invention to fabricate the shafts 18 within a nozzle plate 14 prior to the nozzle plate being applied to the substrate 12. An exemplary nozzle plate 14 may be fabricated from a metallic substrate and include forming the shafts 18 therethrough using techniques such as, without limitation, laser ablation and electroplating. Laser ablated metallic nozzle plates 14 typically have nozzle chamber sidewalls angled at 7°, but may be increased to at least 20° by using a gray scale mask. Likewise, electroplated nozzle chambers may be fabricated with wall angles exceeding 40°. Another exemplary nozzle plate 14 may be fabricated from a polymer photolithographic film that is developed to define the shafts 18. Using either the metallic or polymer film nozzle plate 14, the shafts 18 through the plate are formed completely independent of recess and/or via 20 formation within the substrate 12. In this manner, via 20 and recess formation can occur prior to, concurrent with, or subsequent to shaft 18 formation. The shafts 18 of the nozzle plate 14 may be aligned with preexisting recesses and vias 20, or be aligned with locations where the vias 20 and recesses will be subsequently formed to ensure that the resulting nozzle chambers 24 vertically overly at least a portion of the via 20 to provide direct vertical communication between the via 20 and nozzle chamber 24. It is also within the scope of the invention that the nozzles 16 themselves overly the via 20.

Figure 3:
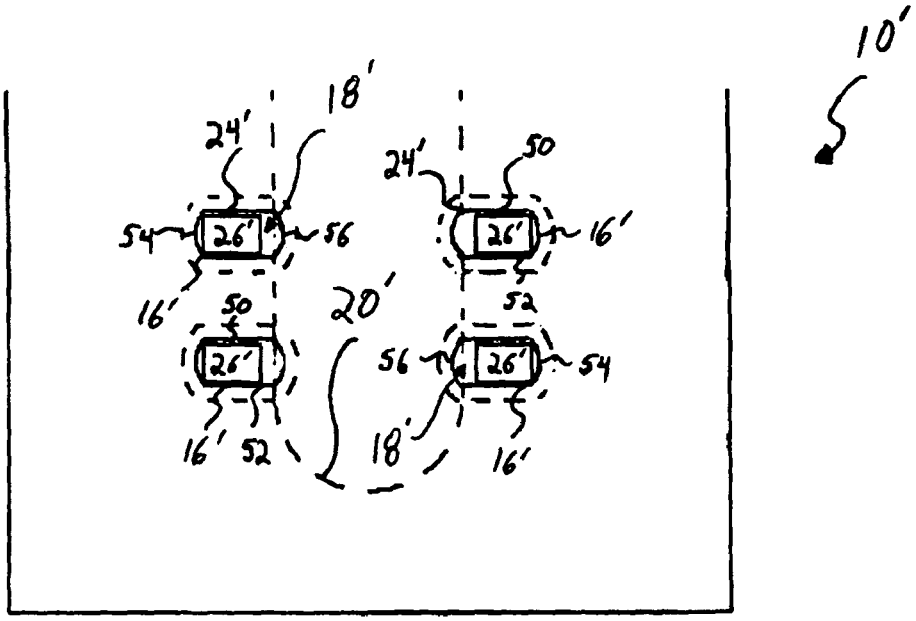
FIG. 3 is an overhead view of a first alternate exemplary printhead in accordance with the present invention.

Referring to FIG. 3, it is also within the scope of the present invention to provide a shaft 18' defining an area other than a frustoconical area by utilization of geometries incorporating cross-sectional areas other than circular cross-sections. In this first alternate exemplary printhead 10', the shafts 18' are defined by two opposite and linear parallel tapered walls 50, 52 that are connected to one another by mirror image conical walls 54, 56. At least one of the conical walls 54 vertically overlies the primary ink via 20' formed within the substrate 12' in order to provide direct communication between the via 20' and nozzle chamber 24'. It should also be noted that each nozzle chamber 24' also overlies the corresponding heater 26'. Presuming the nozzle plate includes a photolithographic composition, the conical walls 54, 56 may be formed by exposing the shafts, 18' to a gray scale mask or a stepper.

It is further within the scope of the present invention to provide a shaft having a sidewall perpendicular or orthogonal to the surface of the substrate. In this manner, nozzle chambers may be fabricated to define a cylindrical area, and elongated cylindrical area, or any other area where the vertical walls of the nozzle chamber are substantially perpendicular to the substrate.

Figure 4:
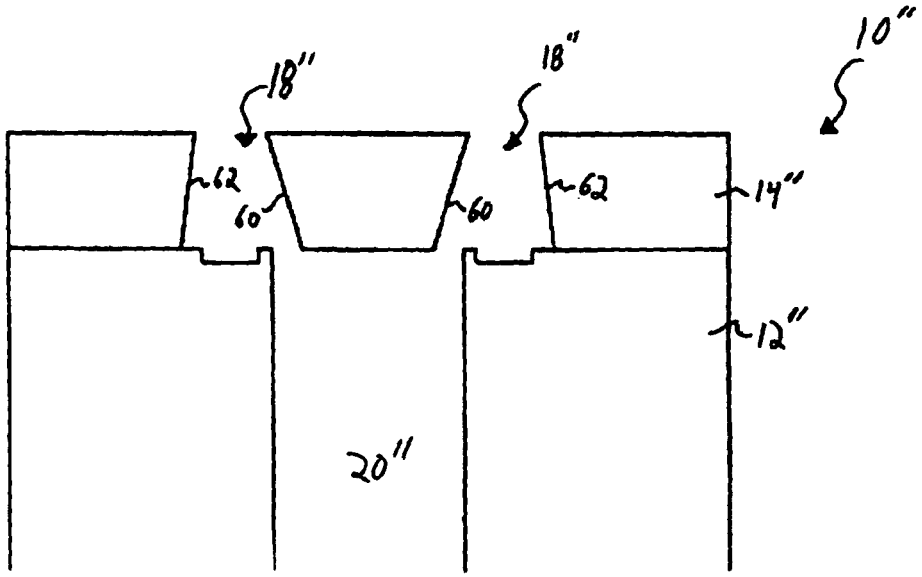
FIG. 4 is a cross-sectional view of a second alternate exemplary printhead in accordance with the present invention.

Referring to FIG. 4, it is also within the scope of the present invention to provide a shaft 18" having walls that are tapered or angled in a non-uniform manner. In this second alternate exemplary printhead 10", at least one wall 60 of the shaft 18" is angled or tapered more so than an opposite wall 62. In an exemplary orientation, the wall 60 overlying the primary ink via 20" is angled more so than the wall 62 overlying the substrate 12", however, it is also within the scope of the present invention to angle the wall 62 overlying the substrate more so than the wall 60 overlying the primary via 20".

Figure 5:
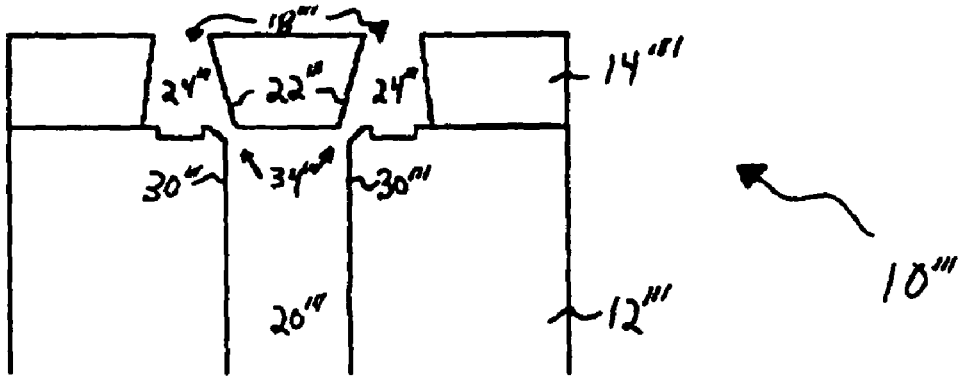
FIG. 5 is a cross-sectional view of a third alternate exemplary printhead in accordance with the present invention.
Figure 6:
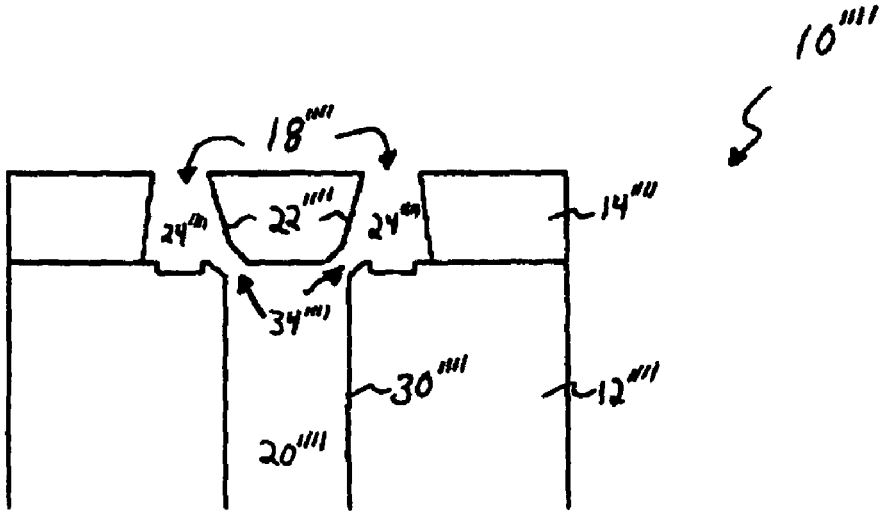
FIG. 6 is a cross-sectional view of a fourth alternate exemplary printhead in accordance with the present invention.

Referring to FIGS. 5 and 6, it is also within the scope of the present invention to fabricate a printhead 10''' that eliminates the normal edges associated with the walls 30''' of the ink via 20''', as well as fabricating a printhead 10''' that concurrently eliminates the normal edges associated with the walls 30'''' of the ink via 20'''' and the sharp edges associated with the walls 22'''' of the shafts 18'''' by chamfering such edges. By chamfering the walls bounding the constriction 34''', 34'''', it is possible to manipulate the refill characteristics of the nozzle chamber 24''', 24'''' without substantially modifying the orientation of the walls bounding the nozzle chamber and the via. Likewise, the volume of the via and each nozzle chambers is substantially unchanged, but provides for various metering of ink between the via and nozzle chamber. For example, by chamfering the walls bounded the constriction, the cross-sectional area of the constriction is increased, which reduces the refill time of the nozzle chamber.

Figure 7:
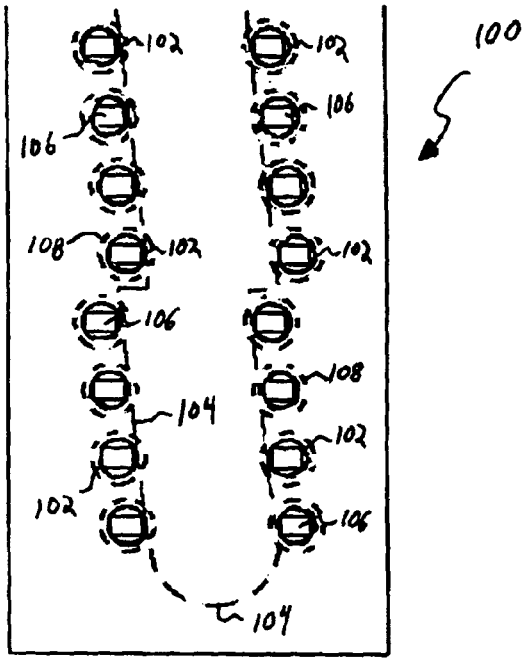
FIG. 7 is an overhead view of a second exemplary printhead in accordance with the present invention.
Figure 8:
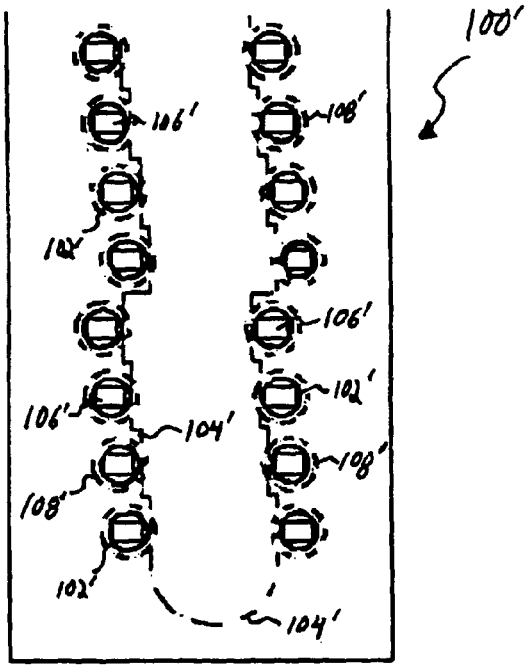
FIG. 8 is an overhead view of an alternate exemplary printhead in accordance with the present invention.

Referencing to FIGS. 7 and 8, a second exemplary printhead 100 and second alternate exemplary printhead 100' each include nozzles 102, 102' that overhang the primary ink via 104, 104' and are horizontally staggered. For purposes of explanation, staggered nozzles 102, 102' include nozzles that are not linearly aligned and are not perpendicular to an edge of the printhead 100, 100'. Staggering of the nozzles reduces the number of heaters 106, 106' that need to fire at the same time in a vertical line printing situation, which advantageously reduces the number of sequential heaters that are fired. The exemplary nozzles 102, 102' and nozzle chambers 108, 108' may be fabricated consistent with any one of the above explanations for fabricating an exemplary embodiment in accordance with the present invention, with the locations of the heaters, 106, 106' being predetermined and eventually dictating the modification of the ink via 104, 104' and the nozzle changers 108, 108'.

Figure 9:
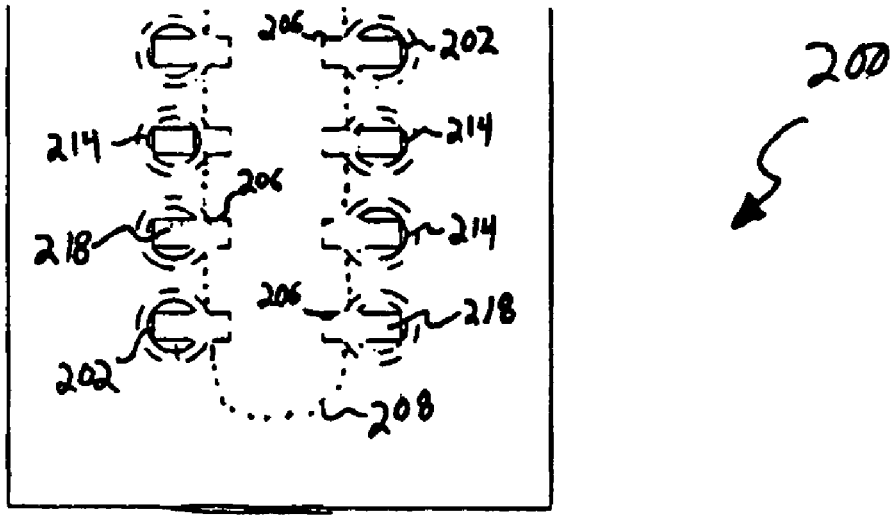
FIG. 9 is an overhead view of a third exemplary printhead in accordance with the present invention.
Figure 10:
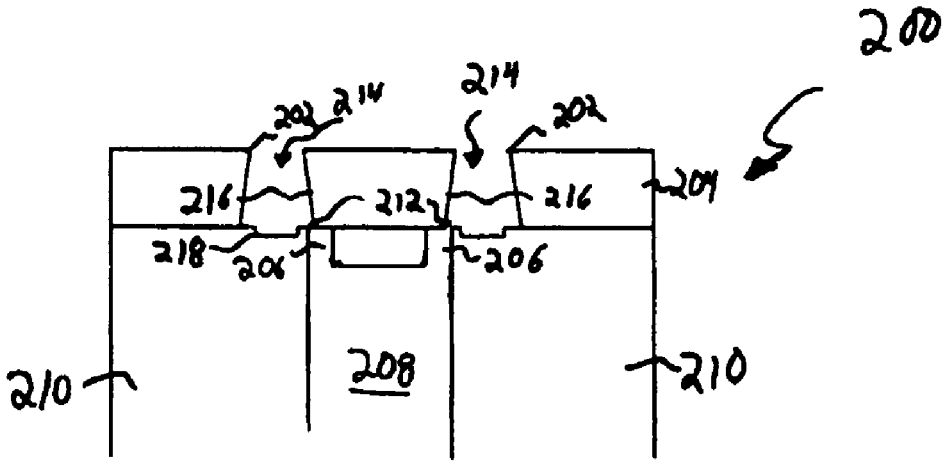
FIG. 10 is a cross-sectional view of the third exemplary printhead of FIG. 9.

Referencing to FIGS. 9 and 10, a third exemplary printhead 200 includes series of nozzles 202 through a nozzle plate 204, where the nozzles 202 overhang a series of orthogonal conduits 206 vertically overlying a primary ink via 208 formed within a silicon substrate 210. The nozzle chambers 214 also vertically overly heaters 218 recessively mounted within the substrate 210. Unlike the exemplary embodiments discussed above that utilize the constriction to primarily meter the ink between the via and the nozzle chamber, this third exemplary printhead 200 utilizes the constriction 212 and associated conduit 206 prefacing the constriction to meter ink between the via 208 and a respective nozzle chamber 214. In this manner, the dimensions of the constriction 212 and the conduit 206 work in tandem to dampen the volumetric flow rate of ink between the primary ink via 208 and the nozzle chambers 214 to prevent ink flooding in proximity to the nozzle 202 prior to ink jetting.

While the exemplary printhead 200 is shown with each nozzle chamber 214 having tapered sidewalls 216 to define a frustoconical area, it is also within the scope of the invention that the walls are oriented normal to the surface of the substrate 210 and/or have cross-sectional areas that are not circular. Likewise, it is within the scope of the invention to eliminate or substantially reduce the sharp and normal edges of the substrate 210 and nozzle plate 204 by chamfering such edges to define the constriction 212 consistent with the explanation above for chamfering constriction boundaries. It is further within the scope of the invention to provide a plurality of conduits 206 feeding a single overhanging nozzle 202.

Fabrication of the second exemplary printhead 200 includes utilization of deep reactive ion etching (DRIE) to define the primary via 208, along with the respective conduits 206 feeding the overhanging nozzle chambers 214. A photolithographic film, that will eventually comprise the nozzle plate 204, is mounted to the substrate 210 and developed to define the nozzles 202 and associated nozzle chambers 214. As discussed above, this film 204 may be a preexisting metallic or polymer film, or a liquid spun deposited over the substrate 210 and thereafter cured to provide a film. The etching utilized to fabricate the via 208 and conduits 206 can occur prior to, subsequent to, or concurrently with the formation of the nozzles 202 and nozzle chambers 214. Those of ordinary skill will be understand the exemplary teachings of the present invention to fabricate obvious variations of the aforementioned exemplary embodiments.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A fluid ejector comprising:

a substrate that includes a primary via formed therein; and a nozzle member overlying the substrate, the nozzle member adjoining the substrate, and including vertical nozzle chambers at least partially overlying the primary via and a corresponding fluid actuator associated with the substrate.

2. The fluid ejector of claim 1, wherein the nozzle member and substrate cooperate to form a constriction that is adapted to meter the flow of fluid between the primary via and at least one vertical nozzle chamber.

3. The fluid ejector of claim 1, wherein at least one of the nozzle member and substrate that cooperate to form the constriction are chamfered.

4. The fluid ejector of claim 1, wherein at least one of the fluid actuators is mounted to the substrate.

5. The fluid ejector of claim 1, wherein fluid from the primary via is adapted to vertically refill each of the vertical nozzle chambers.

6. The fluid ejector of claim 1, wherein at least one of the vertical nozzle chambers includes a tapered wall.

7. The fluid ejector of claim 6, wherein:

the at least one vertical nozzle chamber includes at least two tapered walls;

the first tapered wall is angled greater than the second tapered wall; and the first tapered wall at least partially overlies the primary via.

8. The fluid ejector of claim 6, wherein the tapered wall at least partially defines a frustoconical region.

9. The fluid ejector of claim 1, wherein at least one of the vertical nozzle chambers includes a nozzle orifice at least partially overlying the primary via.

10. The fluid ejector of claim 1, wherein:

the primary via is horizontally staggered;

the fluid actuators are horizontally staggered; and the vertical nozzle chambers are correspondingly horizontally staggered to match the orientation of the fluid actuators and primary via.

11. The fluid ejector of claim 1, wherein the nozzle member is photolithographically developed to define the vertical nozzle chambers.

12. The fluid ejector of claim 1, wherein:

the nozzle member comprises a metallic material; and the vertical nozzle chambers are formed through the nozzle member utilizing at least one of laser ablation and electroplating.

13. The fluid ejector of claim 1, wherein the substrate includes a conduit formed between the primary via and at least one of the vertical nozzle chambers to regulate the refill of fluid into the at least one vertical nozzle chamber.

14. The fluid ejector of claim 1, wherein the substrate includes a plurality of conduits formed between the primary via and at least one of the vertical nozzle chambers to regulate the refill of fluid into the at least one vertical nozzle chamber.

15. A method of fabricating a printhead for an inkjet printing apparatus comprising:

forming an ink via within a substrate;

overlying the substrate with a nozzle plate, the nozzle plate adjoining the substrate; and forming a plurality of orifices through the nozzle plate, where the plurality of orifices are adapted to overlie at least a portion of the ink via and a corresponding heater mounted to the substrate to provide a plurality of overhanging nozzles.

16. The method of claim 15, wherein:

the nozzle plate comprises a photosensitive material; and the photosensitive material is exposed to light and developed in order to form the plurality of overhanging nozzles.

17. The method of claim 16, wherein the act of forming a plurality of orifices through the photosensitive material includes utilizing a photolithographic gray scale mask.

18. The method of claim 15, wherein the act of forming the plurality of orifices through the nozzle plate includes utilization of at least one of laser ablation and electroplating.

19. The method of claim 15, wherein the act of forming the ink via within the substrate occurs prior to overlying the substrate with the nozzle plate.

20. The method of claim 15, wherein the act of overlying the substrate with the nozzle plate occurs prior to the act of forming the plurality of orifices through a second material.

21. The method of claim 15, wherein:

the act of forming the ink via within the substrate occurs subsequent to overlying the substrate with the nozzle plate;

the act of forming the ink via within the substrate includes utilization of at least one of reactive ion etching and chemical etching; and the nozzle plate is operative as an etch stop.

22. The method of claim 15, wherein:

the act of overlying the substrate with the nozzle plate includes at least one of:

laminating a nozzle plate film onto the substrate; and applying a spin-on liquid composition and subsequently developing the spin-on liquid composition to form a nozzle plate film overlying the substrate.

23. The method of claim 15, wherein the act of overlying the substrate with the nozzle plate occurs subsequent to the act of forming the plurality of orifices through the nozzle plate.

* * * * *